United States Patent [19]

Smitley

[11] 4,413,603

[45] Nov. 8, 1983

[54] APPARATUS AND METHOD FOR PREVENTING THE SPILLAGE OF FUEL FROM A FUEL RESERVOIR AND THE LIKE

[75] Inventor: Marion L. Smitley, Birmingham, Mich.

[73] Assignee: Colt Industries Operating Corp, New York, N.Y.

[21] Appl. No.: 332,485

[22] Filed: Dec. 21, 1981

[51] Int. Cl.[3] ..... F02M 39/00

[52] U.S. Cl. ..... 123/510; 123/198 DB

[58] Field of Search ..... 123/510, 511, 512, 198 DB, 123/458

[56] References Cited

U.S. PATENT DOCUMENTS 3,612,021 10/1971 Ross ..... 123/510
3,842,809 10/1974 King ..... 123/510
3,916,865 11/1975 Kiencke et al. ..... 123/198 DB
4,294,204 10/1981 Hurner ..... 123/198 DB

*Primary Examiner*—Charles J. Myhre
*Assistant Examiner*—Magdalen Moy
*Attorney, Agent, or Firm*—Walter Potoroka, Sr.

[57] ABSTRACT

A combustion engine is shown with a fuel metering device having a fuel reservoir or fuel bowl with such, in turn, having a float-controlled fuel inlet valve; a fuel supply conduit leading from a vehicular fuel tank to the inlet of the fuel bowl has a normally open solenoid valve and a flow meter situated in series therewith; a control device receiving signals indicative of engine speed and rate of fuel flow to the fuel bowl is effective to cause the solenoid valve to close and terminate further fuel flow whenever the numerical ratio of the rate of fuel flow divided by the engine speed exceeds a preselected magnitude of such a ratio or index.

26 Claims, 2 Drawing Figures

APPARATUS AND METHOD FOR PREVENTING THE SPILLAGE OF FUEL FROM A FUEL RESERVOIR AND THE LIKE

FIELD OF THE INVENTION

This invention relates generally to fuel supply systems employable in association with combustion engines and more particularly to such fuel supply systems comprising a fuel reservoir or fuel bowl supplying fuel to be metered by the fuel supply system to the engine, and still more particularly to apparatus and method for preventing the spillage of fuel from such fuel reservoirs or fuel bowls and onto, as for example, the associated combustion engine and/or its components and accessories.

BACKGROUND OF THE INVENTION

In many prior art fuel metering systems it is accepted practice to employ a fuel bowl or chamber into which fuel is pumped and from where such fuel is metered to the associated engine. In such systems it is also accepted practice to employ the combination of an inlet valve and float for controlling the rate of fuel flow permitted to be pumped into the fuel bowl or reservoir.

If the rate of fuel flow into the fuel reservoir is greater than the rate of fuel metered from the fuel reservoir and to the associated engine, then the elevational height of the fuel (usually commonly referred to as the "fuel level") increases and if such relatively greater rate of fuel flow into the fuel reservoir is permitted to continue for a sufficient time, the fuel therein will spill out of any available port, vent or conduit and such spilling may occur externally, that is out of the fuel reservoir and onto any adjacent structure, and/or internally through any available passages as within the fuel metering apparatus, especially in carburetor structures, and into the engine intake induction system. Such a fuel spillage caused by the excessive supply of fuel to the fuel reservoir may be referred to as "flooding".

Among the various possible causes leading to such excessive rate of fuel supply to the fuel reservoir are: (a) a damaged float member; (b) a damaged or tampered-with float lever; (c) a particle of dirt preventing the associated inlet valve from properly moving or seating; and (d) excessive wear in one or more elements comprising the float and inlet valve inlet system.

The invention as herein disclosed and claimed is primarily directed to the provision of a method, and apparatus for practicing the method, whereby the condition of flooding is prevented from occurring.

SUMMARY OF THE INVENTION

METHOD

According to the invention a method for preventing the flooding of a fuel reservoir associated with a fuel metering system supplying metered fuel to an associated combustion engine comprises the steps of determining the normal maximum rate of fuel flow to the associated engine, sensing the actual rate of fuel flow to the fuel reservoir, and when the actual rate of fuel flow to the fuel reservoir is sensed to be excessive by exceeding the normal maximum rate, then preventing the continued excessive rate of fuel flow to the fuel reservoir.

APPARATUS

According to the invention apparatus for preventing the flooding of a fuel reservoir associated with a fuel metering system supplying metered fuel to an associated combustion engine comprises a source of fuel, conduit means communicating between said source of fuel and said fuel reservoir, pump means for pumping fuel through said conduit means and to said fuel reservoir, means for sensing the rate of flow of fuel through said conduit means to said fuel reservoir, and valve means effective for at least reducing the rate of flow of said fuel through said conduit means in response to said means for sensing the rate of flow of fuel sensing the rate of flow of fuel to be exceeding a preselected maximum rate of flow of fuel through said conduit means.

Various general and specific objects, advantages and aspects of the invention will become apparent when reference is made to the following detailed description considered in conjunction with the accompanying drawings.

BRIEF DESCRIPTION OF THE DRAWINGS

In the drawings, wherein for purposes of clarity certain details and/or elements may be omitted.

DETAILED DESCRIPTION OF THE PREFERRED EMBODIMENT

Figure 1:
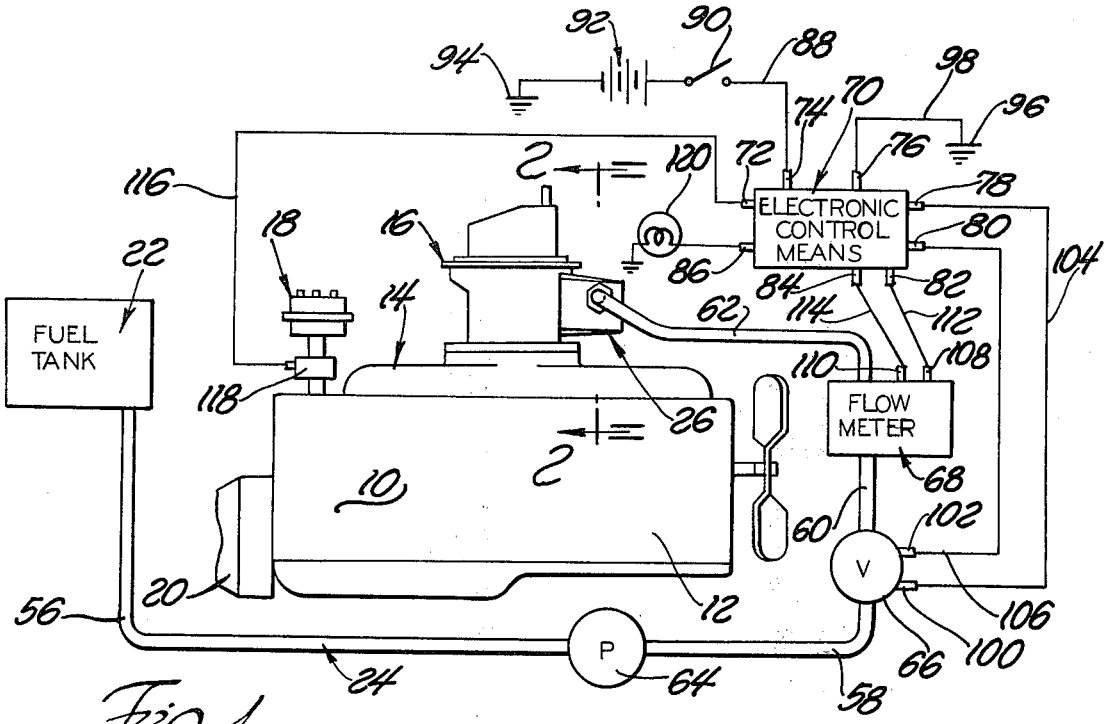
FIG. 1 is a generally schematic view of an internal combustion engine employing a control system employing teachings of the invention.

Referring now in greater detail to the drawings, FIG. 1 illustrates a combustion engine 10 having a main engine block 12 with suitable intake or induction manifold means 14 which, in turn, carries a related carburetor means or assembly 16. An ignition distributor assembly is depicted at 18 and, as usual, operates in timed relationship to engine speed. The engine 10 may be provided with suitable transmission means 20 for, in turn, transmitting power to associated ground-engaging drive wheel means of the associated vehicle.

A vehicular fuel tank 22 is operatively connected as by conduit means 24 to the fuel bowl assembly or reservoir means 26 of the carburetor 16.

Figure 2:
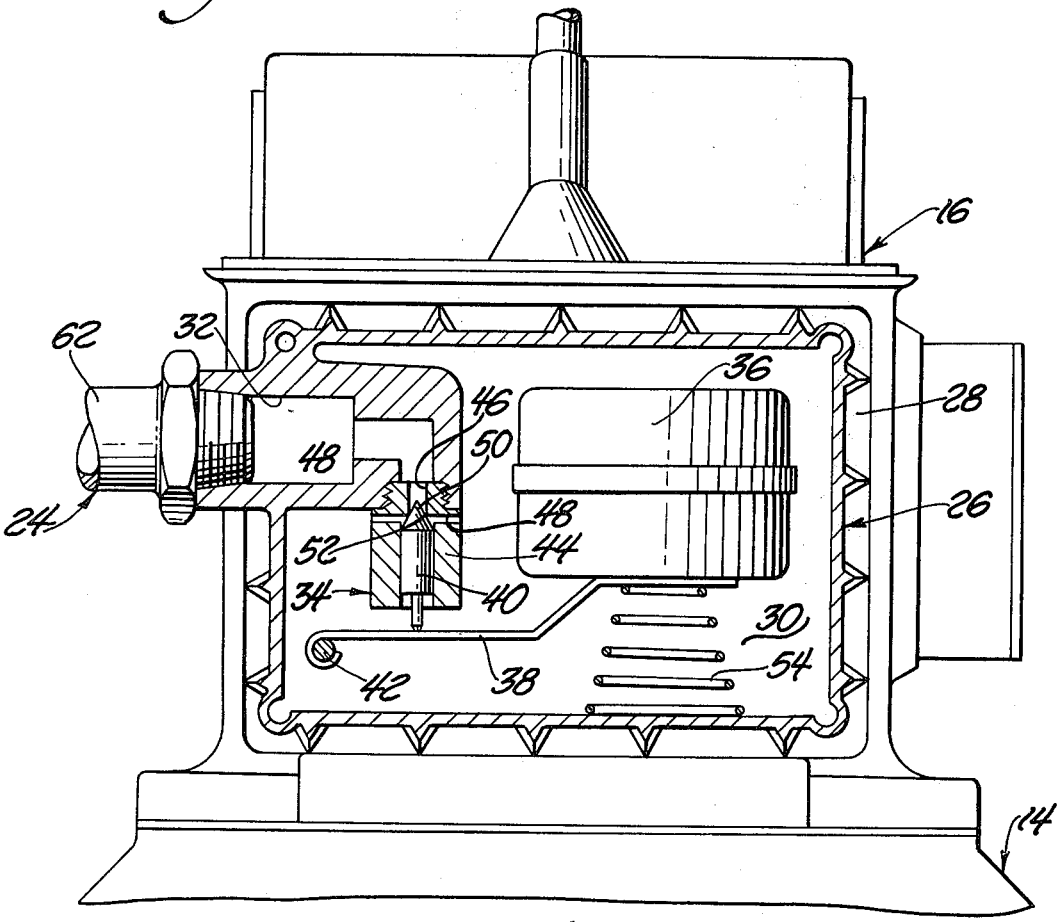
FIG. 2 is an enlarged cross-sectional view taken generally on the plane of line 2—2 of FIG. 1 and looking in the direction of the arrows.

FIG. 2 illustrates, generally typically, the internal construction of the fuel bowl assembly 26. As generally depicted, the reservoir means or fuel bowl assembly comprises outer housing means 28 formed to provide a chamber 30 and a fuel inlet passage 32 communicating with chamber 30 and adapted to be controlled by the valving means 34. A float 36 is provided with an arm or lever 38 adapted to actuate the valving member 40, of valve assembly 34, with the lever or arm 38 being pivotally connected to related pivot means 42. The valve assembly 34, as generally depicted, may be comprised of the valving member 40 slidably received within a housing or body 44 which, in turn, is, as by threadable engagement, suitably secured to the outer housing means 28 as to have a generally axially extending passageway or conduit 46, formed in body 44, in communication with fuel inlet conduit or passage 32. A plurality of generally transverse apertures or passages 48 are provided, as in body 44, to permit the flow of fuel therethrough and into chamber 30 whenever the valve member 40 is positioned as to have its valve surface 50 effectively spaced from the cooperating valve seating surface means 52. A spring 54 may be mounted within the fuel bowl below float 36 so as to, effectively, increase the bouyancy of float 36.

As is generally well known in the art, the inlet or needle valve 40 is positioned within the body portion 44 of assembly 34 by the float arm or lever means 38 which, in turn, is determined by the position of the float 36. The float 36 position, at any given time, is, of course, determined by the instantaneous fuel level within fuel bowl chamber 30.

Referring again to FIG. 1, the conduit means 24 is depicted as comprising conduit portions or sections 56, 58, 60 and 62 with conduit section or portion leading from the fuel tank or fuel supply 22 to the inlet of associated fuel pump means 64. Conduit portion 58 operatively completes communication as between the outlet of pump means 64 and the inlet of control valve means 66. Conduit portion or section 60 operatively completes communication as between the outlet of control valve means 66 and the inlet of flow meter or flow gauging means 68 which, in turn, has its outlet placed in communication with the fuel bowl assembly 26 as via conduit portion or section 62. It should, of course, be clear that even though the fuel pump means 64 has been illustrated as being situated externally of vehicular fuel tank means 22, the practice of the invention is not so limited and the fuel pump means 64 may be located in any desired location as, for example, internally of the fuel tank means 22.

A suitable electronic control means 70 is illustrated as being provided with electrical terminal means 72, 74, 76, 78, 80, 82, 84 and 86. The control means 70 may be electrically connected via terminal 74, conductor means 88 and switch means 90 to a suitable source of electrical potential 92 which may be electrically grounded as at 94. Switch means 90 may, in fact, be the usual key-operated vehicular engine ignition switch so that, preferably, the circuit through conductor means 88 would be open except during engine operation.

Terminal 76 may be brought to ground potential, as at 96, as by conductor means 98.

Terminals 78 and 80 are respectively electrically connected to cooperating terminals 100 and 102 of control valve means 66 as by electrical conductor means 104 and 106.

Terminals 82 and 84 are respectively electrically connected to cooperating terminals 108 and 110 of flow meter or flow sensing means 68 as by electrical conductor means 112 and 114.

Terminal 72 is electrically connected, as via conductor means 116, to speed sensing and output signal producing means 118 shown associated with said ignition distributor assembly 18 as to produce a signal indicative of the speed thereof and, since the ignition distributor assembly operates in timed relationship to engine speed, such speed signal produced by means 118 is, in fact, an engine speed signal.

In the preferred embodiment of the invention the control valve means 66 comprises a solenoid valve assembly which, under normal circumstances or operating conditions, is open as to permit the free flow of fuel therethrough (from conduit section 58 to conduit portion 60).

Further, in the preferred embodiment of the invention, flow meter or flow sensing means 68 senses the velocity rate of flow of fuel therethrough (as from conduit portion 60 to conduit section 62) and produces an output signal in response thereto with such signal being applied to the electronic control means 70 as by conductor means 112 and 114. Since the effective flow area through the flow meter or sensing means will, as a practical matter, be known, the sensed velocity rate of flow of fuel will actually be the volume rate of flow of fuel therethrough and to the fuel bowl assembly 26 and, therefore, the signal produced in response to such flow and applied to control means 70 will actually be a signal indicative of the volume rate of fuel flow to the fuel bowl assembly 70.

OPERATION OF THE INVENTION

It has been discovered that the ratio of fuel flow divided by RPM is nearly constant for all engines. Therefore a maximum ratio for the engine can be established. For example, with a particular six cylinder engine test data indicates that the permissible (or desired) maximum volume rate of fuel flow at wide open throttle engine operation when divided by the engine speed (in terms of r.p.m.) resulted in a ratio or index of approximately 0.02. This ratio remains somewhat constant at all engine speeds. Therefore, if an excessive rate of fuel flow to the carburetor fuel bowl assembly were to occur, the resulting index or ratio of fuel flow to engine speed (FF/RPM) would be greater (in numerical value) than the said index or ratio of 0.02. Another way of looking at this is in the reverse. That is, if from the various factors it can be established that the factor or ratio is greater than said 0.02 then it is known that an excessive rate of fuel flow is being supplied to the fuel bowl assembly 26.

Referring to both FIGS. 1 and 2, in the preferred embodiment of the invention the maximum fuel flow index for engine 10 would first be established or determined and, for purposes of description, let it be assumed that the "max. fuel flow" index or ratio is 0.02 and that such has been determined at wide open throttle engine operation.

The flow meter 69 would then produce a signal indicative of the magnitude of the volume rate of fuel flow to the fuel bowl assembly 26 during engine operation and such signal would continuously be applied as via conductor means 112, 114 to the control means 70. Further, continuously during engine operation, the engine speed sense means 118 would sense the engine speed and produce a signal indicative of the magnitude thereof and apply such signal as via conductor means 116 to the control means 70. Whenever the electronic control means 70 sensed that the magnitudes of the fuel flow signal and the engine speed signal were such as to result in a fuel flow index or ratio greater than the assumed value of 0.02 to electronic control means would cause solenoid valving means 66 to become energized, as via conductor means 104, 106, and close thereby terminating further fuel flow from fuel conduit portion 58 to conduit portions 60 and 62 and to fuel bowl assembly 26.

The solenoid valving assembly 66 could be of the type that once it was energized into a closed condition, it would not again open, even upon removal of the electrical energization and would have to be manually opened by manual re-set to an opened condition. In the alternative, the electronic control means 70 could be of the type wherein once it energizes and causes solenoid valving means 66 to assume a closed condition the control means 70 continues to maintain energization of the solenoid assembly 66 even after termination of fuel flow through solenoid assembly 66 until such time that a manual re-set of the control means 70 is affected.

In any event, once the "max. fuel flow" index or ratio is exceeded, valve means 66 terminates further fuel flow to the fuel bowl assembly 26 leaving only that amount of fuel within fuel chamber 30, as was previously delivered, with which to continue engine operation. In this regard, in the preferred embodiment, suitable vehicle operator warning or signaling means are provided. That is, vehicle operator directed sensory signal means 120 depicted as being operatively electrically connected to terminal means 86 becomes energized whenever solenoid valve means 66 is closed thereby giving notice to the vehicle operator that fuel flow to the carburetor fuel bowl or reservoir means 26 has been terminated and that the vehicle operator should take appropriate action to drive the vehicle to a safe stopping area. Generally, the amount of fuel within the fuel bowl chamber 30 is sufficient to permit continued engine operation for about 0.2 to 0.3 mile which is adequate for seeking and stopping the vehicle within a safe area. The vehicle operator can then attend to the cause of the excessive rate of fuel flow.

In the preferred embodiment of the invention it is also desirable to provide a slight margin or difference as between the actually determined "max. fuel flow" index or ratio and the value of the index or ratio at which the electronic control means 70 will respond by causing valving means 66 to become closed. That is, for example, if the actual "max. fuel flow" index or ratio (which, in the main will be empirically determined) is the assumed value of 0.02 then it is preferred that that magnitude or value of the index or ratio at which the electronic control means actually causes the solenoid valve means 66 to become closed be in the order of, for example, 0.025 or some other ratio slightly but safely greater than the empirically determined index or ratio thereby eliminating the possibility of an erroneous shut-off of fuel flow by the solenoid valve means 66 because of a temporarily rich (in terms of fuel) running engine.

It should also be understood that with some engines it might be desirable to establish at a series of selected engine speeds, spanning the entire spectrum of engine speeds, the maximum rate of fuel flow at each of such selected engine speeds (and even extrapolating between such selected engine speeds). If at such selected engine speeds the "max. fuel flow" ratios or indicies should vary considerably from each other than the electronic control means could be accordingly programmed to be sensitive to each varying engine speed signal and compare to such the magnitude of the signal generated by the rate of fuel flow to thereby determine whether the resulting ratio (FF/RPM) is within or without the corresponding acceptable index or ratio. Also, in such an event, the preselected respective indicies or ratios would preferably be of a magnitude slightly but safely greater than the respective empirically determined indicies or ratios.

Further, in the preferred practice of the invention, the flow sensing or meter means 68 would be situated as to be at a location upstream of any connection point in the conduit means 24 furthermost away from the fuel bowl assembly 26. By so locating the flow meter means 68, it would respond to any leakages that might occur in the conduit means 24 downstream of the fuel flow meter 68 and thereby serve as a further safety device for the prevention of spilled-fuel-initiated fires. For example, if the fuel conduit means 24 should become loosened at one of its connections, the fuel leaking therefrom would spill either onto the ground or some portion of the hot engine. However, with the flow meter 68 being upstream of any such leaking or loose connection the fuel, as it started to spill would (as far as the flow meter means 68 would known) add to the fuel rate actually being supplied to fuel bowl means thereby increasing the sensed fuel flow index or ratio above the corresponding permissible "max. fuel flow" ratio or index resulting in solenoid valve means 66 causing to become closed and terminating further fuel flow.

Although only a preferred embodiment and selected modifications of the invention have been disclosed and described, it is apparent that other embodiments and modifications of the invention are possible within the scope of the appended claims.

What is claimed is:

1. Apparatus for preventing the flooding of a fuel reservoir associated with a fuel metering system supplying metered fuel to an associated combustion engine, said apparatus comprising fuel supply conduit means for supplying fuel to said fuel reservoir, normally open valve means in fluid circuit with said fuel supply conduit means, and additional means responsive to the rate of fuel flow through said fuel supply conduit means and to the speed of said engine, said additional means being effective upon the occurrence of an abnormal condition to cause said normally open valve means to become closed, said abnormal condition occurring when said additional means senses that the numerical value of the ratio of the rate of fuel flow actually being supplied through said fuel supply conduit means divided by the then speed of said engine exceeds a preselected numerical value.

2. Apparatus according to claim 1 and further comprising sensory indicator means for indicating that said abnormal condition has occurred.

3. Apparatus according to claim 1 wherein said normally open valve means comprises solenoid operated valve means.

4. Apparatus according to claim 3 and further comprising sensory indicating means for indicating that said abnormal condition has occurred.

5. Apparatus according to claim 1 wherein said additional means comprises fluid flow meter means in said fluid circuit.

6. Apparatus according to claim 5 and further comprising sensory indicator means for indicating that said abnormal condition has occurred.

7. Apparatus according to claim 1 wherein said normally open valve means comprises solenoid operated valve means, and wherein said additional means comprises fluid flow meter means in said fluid circuit.

8. Apparatus according to claim 7 and further comprising sensory indicator means for indicating that said abnormal condition has occurred.

9. Apparatus according to claim 1 wherein said normally open valve means comprises solenoid operated valve means, wherein said additional means comprises fluid flow meter means in said fluid circuit, and wherein said solenoid operated valve means is situated in said fluid circuit upstream of said fluid flow meter means.

10. Apparatus according to claim 9 and further comprising sensory indicator means for indicating that said abnormal condition has occurred.

11. Apparatus according to claim 1 wherein said additional means comprises fluid flow meter means in said fluid circuit, and wherein said fluid flow meter means is situated in said fluid circuit downstream of said normally open valve means.

12. Apparatus according to claim 11 and further comprising sensory indicator means for indicating that said abnormal condition has occurred.

13. Apparatus for preventing the flooding of a fuel reservoir associated with a fuel metering system supplying metered fuel to an associated combustion engine, said apparatus comprising fuel supply conduit means for supplying fuel to said fuel reservoir, normally open valve means in fluid circuit with said fuel supply conduit means, and additional means responsive to the rate of fuel flow through said fuel supply conduit means and to the speed of said engine, said additional means being effective upon the occurrence of an abnormal condition to cause said normally open valve means to become closed, said abnormal condition occurring when said additional means senses that the numerical value of the ratio of the rate of fuel flow actually being supplied through said fuel supply conduit means divided by the then speed of said engine exceeds a preselected numerical value, said additional means comprising speed responsive means responsive to and effective for producing a first output signal indicative of the speed of said engine, said additional means further comprising fluid flow meter means in said fluid circuit responsive to and effective for producing a second output signal indicative of the rate of fuel flow through said fluid circuit, and said additional means further comprising control means for receiving said first and second signals and upon the occurrence of said abnormal condition being effective to close said normally open valve means.

14. Apparatus according to claim 13 and further comprising sensory indicator means for indicating that said abnormal condition has occurred.

15. Apparatus according to claim 13 wherein said fluid flow meter means is situated in said fluid circuit downstream of said normally open valve means.

16. Apparatus according to claim 15 and further comprising sensory indicator means for indicating that said abnormal condition has occurred.

17. Apparatus according to claim 13 wherein said normally open valve means comprises solenoid operated valve means, and wherein said fluid flow meter means is situated in said fluid circuit downstream of said solenoid operated valve means.

18. Apparatus according to claim 17 and further comprising sensory indicator means for indicating that said abnormal condition has occurred.

19. A method of preventing the flooding of a fuel reservoir associated with a fuel metering system supplying metered fuel to an associated combustion engine, comprising the steps of determining the normal maximum rate of fuel flow to the associated engine during at least a preselected engine speed, measuring the actual rate of fuel flow to the fuel reservoir during engine operation, measuring the speed of said engine during engine operation, and terminating further flow of fuel to said fuel reservoir when the measured actual rate of fuel flow to the fuel reservoir exceeds said normal maximum rate of fuel flow during said preselected engine speed.

20. Apparatus according to claim 2 wherein said sensory indicator means comprises electrically energizable lamp means.

21. Apparatus according to claim 3 wherein said solenoid operated valve means when closed remains closed until subsequently manually re-set to its normally open condition.

22. Apparatus according to claim 3 wherein said additional means continues to cause energization and closure of said solenoid valve means even after termination of fuel flow through said solenoid valve means, said energization of said solenoid valve means continuing until such time as said additional means is manually re-set.

23. Apparatus according to claim 7 wherein said solenoid operated valve means when closed remains closed until subsequently manually re-set to its normally open condition.

24. Apparatus according to claim 13 wherein said normally open valve means comprises solenoid operated valve means.

25. Apparatus according to claim 13 wherein said normally open valve means comprises solenoid operated valve means, and wherein said solenoid operated valve means when closed remains closed until subsequently manually re-set to its normally open condition.

26. Apparatus according to claim 14 wherein said sensory indicator means comprises electrically energizable lamp means.

* * * * *